US008483592B2

(12) United States Patent
Holmes et al.

(10) Patent No.: US 8,483,592 B2
(45) Date of Patent: Jul. 9, 2013

(54) METHODS AND DEVICES FOR REMANUFACTURING PRINTER CARTRIDGES

(75) Inventors: Denny Holmes, Los Angeles, CA (US); Tigran Ohanyan, Van Nuys, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 0 days.

(21) Appl. No.: 13/507,595

(22) Filed: Jul. 11, 2012

(65) Prior Publication Data

US 2012/0275817 A1 Nov. 1, 2012

Related U.S. Application Data

(62) Division of application No. 12/592,764, filed on Dec. 1, 2009, now Pat. No. 8,249,483.

(60) Provisional application No. 61/201,187, filed on Dec. 8, 2008.

(51) Int. Cl.
*G03G 15/00* (2006.01)

(52) U.S. Cl.
USPC ..... 399/109

(58) Field of Classification Search
USPC ..... 399/109, 116, 159, 167; 29/411, 29/412, 426.1, 426.4, 895.1
See application file for complete search history.

(56) References Cited

U.S. PATENT DOCUMENTS

| | | | | |
|---|---|---|---|---|
| 7,104,738 | B2 * | 9/2006 | Cantlon | 408/204 |
| 7,280,783 | B2 * | 10/2007 | Kusano et al. | 399/109 |
| 7,346,292 | B2 * | 3/2008 | Williams et al. | 399/109 |
| 7,546,062 | B2 * | 6/2009 | Ohanyan | 399/109 |
| 7,680,435 | B2 * | 3/2010 | Kusano | 399/117 |
| 7,840,158 | B2 * | 11/2010 | Ohanyan | 399/109 |

FOREIGN PATENT DOCUMENTS

| | | | |
|---|---|---|---|
| JP | 07064298 | A * | 3/1995 |
| JP | 11242350 | A * | 9/1999 |
| JP | 2009265253 | A * | 11/2009 |

* cited by examiner

*Primary Examiner* — Robert Beatty

(57) ABSTRACT

Methods and devices for remanufacturing printer cartridges are provided where the printer cartridges comprise a photoconductive drum, the photoconductive drum comprises a drum gear end, and the drum gear end of the photoconductive drum is configured to be attached to a laser printer via a rotational force transmitting assembly. In an embodiment, the method comprises removing the rotational force transmitting assembly from the photoconductive drum, providing a replacement photoconductive drum, and attaching the rotational force transmitting assembly to the replacement photoconductive drum.

6 Claims, 15 Drawing Sheets

METHODS AND DEVICES FOR REMANUFACTURING PRINTER CARTRIDGES

CROSS REFERENCE TO RELATED APPLICATION

This application is a divisional of application Ser. No. 12/592,764, filed Dec. 1, 2009, which is incorporated herein by reference in its entirety and which application Ser. No. 12/592,764 claims the benefit of U.S. Provisional Patent Application Ser. No. 61/201,187, filed Dec. 8, 2008, which is incorporated herein by reference in its entirety.

BACKGROUND OF THE INVENTION a. Field of the Invention

The invention relates to electrophotography, particularly methods and devices for replacing photoconductive drums and methods and devices for remanufacturing printer cartridges.

b. Background Art

Remanufactured printer cartridges offer consumers an environmentally friendly and economical alternative to buying printer cartridges from the original equipment manufacturers (OEMs). Remanufactured printer cartridges come from used cartridges that go through a systematic remanufacturing process. The remanufacturing process typically includes replacing various worn parts, cleaning the printer cartridge, refilling the printer cartridge with toner, and sealing the printer cartridge.

Photoconductive drums, also referred to as organic photoconductor (OPC) drums, are usually replaced when remanufacturing worn printer cartridges. Photoconductive drums are key components of electrophotographic image forming devices such as laser printers. Photoconductive drums are typically cylinders coated with a substance whose magnetic properties change in the presence of light. The photoconductive drum is magnetically charged and the laser changes the charge on the parts of the photoconductive drum it passes over. Those areas will pick up toner and apply it to the page. Certain photoconductive drums are attached to the printer with rotational force transmitting assemblies, such as those described in US patent application number US 2008/0260428. According to this patent application, rotational force transmitting assemblies enable photoconductive drums to be mounted and demounted to printers with substantially vertical movements while at the same time allowing the drums to be smoothly and uniformly rotated. Methods and devices for replacing photoconductive drums attached to printers with rotational force transmitting assemblies are desired and are addressed by the invention.

SUMMARY

In one embodiment there is provided a method of replacing a photoconductive drum of a printer cartridge where the photoconductive drum is configured to be attached to a laser printer via a rotational force transmitting assembly, and the photoconductive drum comprises a drum gear end and a drum flange positioned at the drum gear end. The rotational force transmitting assembly comprises a drum gear coupling member attached to the drum flange. The rotational force transmitting assembly further comprises a drive shaft attached to the drum gear coupling member. The method comprises cutting the drum flange and removing the drum gear coupling member from the drum flange. The method may further comprise providing a replacement photoconductive drum, the replacement photoconductive drum comprising a replacement drum gear end and a replacement drum flange positioned at the replacement drum gear end, and attaching the drum gear coupling member to the replacement drum flange of the replacement photoconductive drum. The cutting the drum flange may comprise providing a hole saw, the hole saw defining a recessed body, attaching the hole saw to a drill, inserting the drive shaft through the recessed body of the hole saw, and rotating the hole using the drill. The method may further comprise providing a protective sheet of material and positioning the protective sheet of material inside the recessed body of the hole saw, providing a fixture configured to support the photoconductive drum, mounting the photoconductive drum to the fixture, and supporting the hole saw in a manner that allows the hole saw to be aligned with the drum flange of the photoconductive drum.

In another embodiment there is provided a method for remanufacturing a laser printer cartridge where the printer cartridge comprises a photoconductive drum, and the photoconductive drum comprises a drum gear end where the drum gear end of the photoconductive drum is configured to be attached to a printer via a rotational force transmitting assembly. The drum gear end comprises a drum flange, and the rotational force transmitting assembly is attached to the drum flange. The method comprises removing the rotational force transmitting assembly from the photoconductive drum, providing a replacement photoconductive drum, and attaching the rotational force transmitting assembly to the replacement photoconductive drum. The replacement photoconductive drum comprises a replacement drum flange, the rotational force transmitting assembly comprises a drum gear coupling member and a drive shaft attached to the drum gear end coupling member, the replacement drum flange defining a recess configured to accommodate the drum gear end coupling member. The method may further comprise providing a hole saw, the hole saw comprising a recessed body, providing a protective material, substantially surrounding the recessed body of the hole saw with the protective material, the protective material being configured to substantially minimize damage to the rotational force transmitting assembly, providing a drill, attaching the drill to the hole saw, rotating the hole saw using the drill to cut the drum flange, providing a fixture, supporting the photoconductive drum with the fixture, supporting the hole saw with the fixture, and aligning the hole saw with the drum flange.

In another embodiment there is provided a method of replacing a photoconductive drum of a printer cartridge, the photoconductive drum configured to be attached to a laser printer via a rotational force transmitting assembly. The photoconductive drum comprises a drum gear end and a drum flange positioned at the drum gear end. The rotational force transmitting assembly comprises a drum gear coupling member attached to the drum flange, the rotational force transmitting assembly further comprising a drive shaft attached to the drum gear coupling member. The method comprising providing a tool having an elongated body with a first bent end having a C-shaped claw portion, a second elongated end, and a press part having an opening, the press part being attached to the elongated body. The method further comprises coupling the C-shaped claw portion to the rotational force transmitting assembly. The method further comprises removing the rotational force transmitting assembly from the photoconductive drum by rotating the tool and pulling out the rotational force transmitting assembly from the photoconductive drum. The method further comprises inserting the removed rotational force transmitting assembly into the opening of the press part. The method further comprises attaching the removed rotational force transmitting assembly into a replacement photoconductive drum. The replacement photoconductive drum comprises a replacement drum flange, the rotational force transmitting assembly comprises a drum gear coupling member and a drive shaft attached to the drum gear end coupling member, the replacement drum flange defining a recess configured to accommodate the drum gear end coupling member. The press part may be permanently fixed to the elongated body or removably attached to the elongated body.

In another embodiment there is provided a device for removing a rotational force transmitting assembly of a photoconductive drum of a printer cartridge where the rotational force transmitting assembly comprises a drum gear coupling member configured to attach to a drum flange, and the drum gear coupling member has a predetermined diameter. The device comprises a hole saw comprising a cylindrical body. The cylindrical body has an internal diameter that is greater than the diameter of the drum gear coupling member. The cylindrical body has a height that allows at least a portion of the cylindrical body to penetrate through the drum flange. Preferably, the cylindrical body of the hole saw defines a recess. The device may further comprise a protective sheet of material. The protective sheet of material may be configured to be positioned within the recess to substantially prevent damage to the rotational force transmitting assembly. The device may further comprise a drill configured to rotate the hole saw. The device may further comprise a fixture comprising a base, at least one mounting block attached to the base, the at least one mounting block being configured to support a photoconductive drum, and a drill shaft guide connected to the base, the drill shaft guide configured to confine a drill shaft positioned between the hole saw and a drill, wherein the placement of the drill shaft guide relative to the at least one mounting block allows the hole saw to be aligned with the drum flange of the photoconductive drum that is supported by the at least one mounting block.

In another embodiment there is provided a device for removing a rotational force transmitting assembly of a photoconductive drum. The device comprises a clamp configured to grasp the rotational force transmitting assembly, and a driving assembly attached to the clamp, the driving assembly configured to move the clamp. The rotational force transmitting assembly is removed from the photoconductive drum by the movement of the clamp. The driving assembly may comprise a jack screw, a rack and pinion gear, or another suitable driving assembly. The device may further comprise a frame. The driving assembly may comprise a drive shaft supported by the frame, the drive shaft being attached to the clamp, a pivot arm attached at an angle to the drive shaft, and, a handle attached to the pivot arm, wherein the handle is moved in a first direction such that the handle moves the pivot arm, the drive shaft, and the clamp to detach the rotational force transmitting assembly from the photoconductive drum.

In another embodiment there is provided a device for removing and attaching a rotational force transmitting assembly of a photoconductive drum. The rotational force transmitting assembly comprises a drum gear coupling member configured to attach to a drum flange. The device comprises a unitary device having an elongated body with a first bent end having a C-shaped claw portion for engagement with the rotational force transmitting assembly in order to remove the rotational force transmitting assembly from the photoconductive drum. The elongated body further has a second elongated end. The device further comprises a press part attached to the elongated body. The press part has an opening for engagement with the rotational force transmitting assembly in order to attach the rotational force transmitting assembly to the photoconductive drum.

In another embodiment, there is provided a device for replacing a photoconductive drum of a printer cartridge, the photoconductive drum configured to be attached to a laser printer via a rotational force transmitting assembly, the photoconductive drum comprising a drum gear end and a drum flange positioned at the drum gear end. The device comprises a tool having an elongated body with a first bent end having a C-shaped claw portion for engagement with the rotational force transmitting assembly in order to remove the rotational force transmitting assembly from the photoconductive drum, the elongated body further having a second elongated end. The device further comprises a press part attached to the elongated body, wherein the press part has an opening for engagement with the rotational force transmitting assembly in order to attach the rotational force transmitting assembly to a replacement photoconductive drum. The press part may comprise a one piece press part with one portion or a one piece press part with two portions. The press part may be permanently fixed to the elongated body or the press part may be removably attached to the elongated body.

The above description sets forth, rather broadly, a summary of embodiments of the invention so that the detailed description that follows may be better understood and contributions of the invention to the art may be better appreciated. Some of the embodiments of the invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DESCRIPTION OF DRAWINGS

The invention can be better understood with reference to the following detailed description taken in conjunction with the accompanying drawings which illustrate preferred and exemplary embodiments, but which are not necessarily drawn to scale, wherein.

DETAILED DESCRIPTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the invention. Also, it is to be understood that the phraseology and terminology employed herein are for the purpose of description and should not be regarded as limiting.

Figure 1:
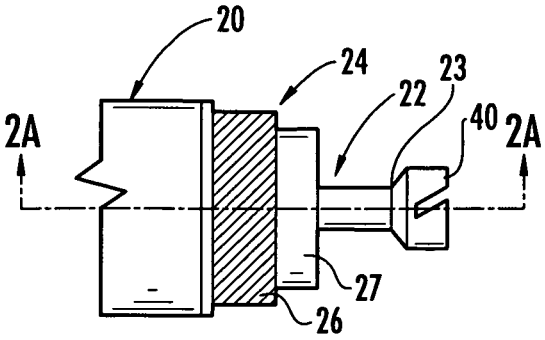
FIG. 1 (PRIOR ART)
FIG. 1 is a partial side view of a prior art photoconductive drum or OPC drum showing a drum gear and a rotational force transmitting assembly.

Printer cartridges include photoconductive drums, also known as organic photoconductor (OPC) drums. When a printer prints on a sheet of paper, photoconductive drums or OPC drums are rotated so that they can be coated by toner. Paper comes in contact with the rotating photoconductive drum or OPC drum, and the print pattern is transferred from the photoconductive drum or OPC drum to the paper. Referring to FIG. 1, some existing printer cartridges, such as printer cartridges for HP2055 printers, include a photoconductive drum or OPC drum 20 that is attached to a printer (not shown) via a rotational force transmitting assembly 22. FIG. 1 is a partial side view of a prior art photoconductive drum or OPC drum 20 showing a drum gear 26 and a rotational force transmitting assembly 22. The photoconductive drum or OPC drum 20 has two ends, including a contact end (not shown) and a drum gear end 24. At the drum gear end 24, the photoconductive drum or OPC drum 20 includes the drum gear 26, a drum hub 27, and the rotational force transmitting assembly 22 attached to the drum gear 26. The rotational force transmitting assembly 22 enables the photoconductive drum or OPC drum 20 to be mounted to and demounted from a printer cartridge 81 (see, for example, FIG. 6A) with substantially vertical movements while at the same time allowing the photoconductive drum or OPC drum 20 to be smoothly and uniformly rotated.

Figure 2A:
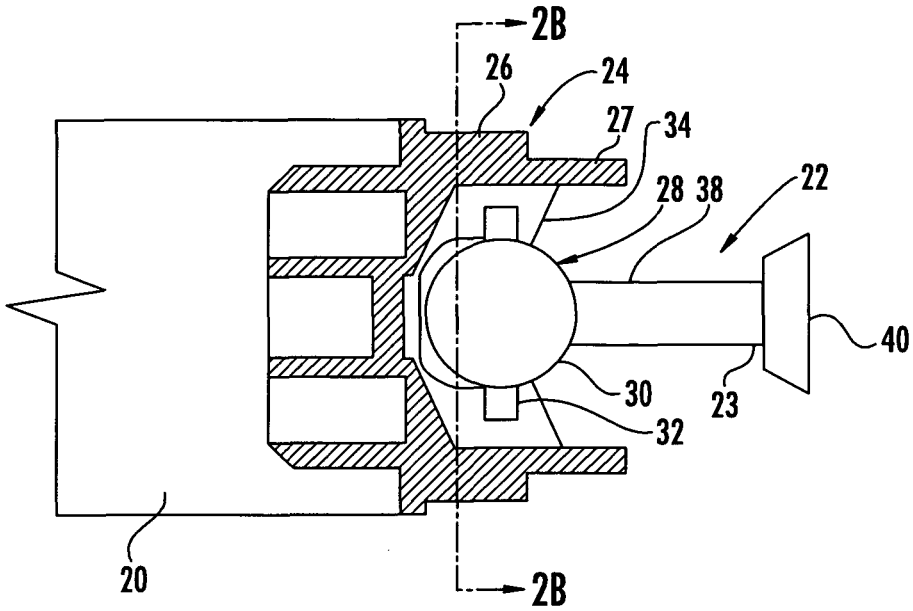
FIG. 2A (PRIOR ART)
FIG. 2A is a cross-sectional view taken along lines 2A-2A of FIG. 1.
Figure 2B:
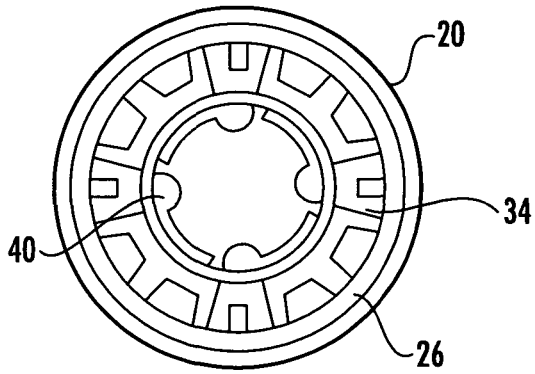
FIG. 2B (PRIOR ART)
FIG. 2B is a cross-sectional view taken along lines 2B-2B of FIG. 2A.

FIG. 2A is a cross-sectional view taken along lines 2A-2A of FIG. 1. FIG. 2B is a cross-sectional view taken along lines 2B-2B of FIG. 2A. Referring now to FIGS. 2A and 2B, the rotational force transmitting assembly 22 is preferably in the form of a drum drive axle 23 and comprises a drive shaft 38 that is attached to a drum gear coupling member 28. The drum gear coupling member 28 is in a form of a ball 30 and a pin 32 that traverses the ball 30. The drum gear end 24 of the OPC drum 20 includes a drum flange 34 configured to engageably receive the ball 30. Once the ball 30 is positioned within the drum flange 34, the ball 30 is secured within the drum flange 34, thereby mounting the drive shaft 38 to the OPC drum 20. The rotational force transmitting assembly 22 further comprises a printer coupling member 40, which is configured to attach the OPC drum 20 to a drum driving gear (not shown) of the printer. The drum driving gear of the printer is substantially coaxial with the axis of the drive shaft 38. The rotation of the drum driving gear of the printer causes the rotation of the drive shaft 38 and consequently the rotation of the OPC drum 20.

Methods and Devices for Replacing a Photoconductive Drum or OPC—The invention comprises methods and devices for replacing photoconductive drums or OPC drums having rotational force transmitting assemblies. In general, the methods of replacing a photoconductive drum or OPC drum include the following steps: removing the rotational force transmitting assembly, providing a replacement photoconductive drum or OPC drum, and attaching the rotational force transmitting assembly to the replacement photoconductive drum or OPC drum. The step of removing the rotational force transmitting assembly can be executed by various ways. For instance, the rotational force transmitting assembly may be removed by cutting the drum flange while ensuring the drum gear coupling member parts, including the ball and the pin, are not damaged. The rotational force transmitting assembly may also be removed by applying force to pull the rotational force transmitting assembly away from the drum flange until it gets detached. Various devices described below may be used in applying force to remove the rotational force transmitting assembly from the photoconductive drum or OPC drum. The replacement photoconductive drum or OPC drum may be similar to the photoconductive drum or OPC drum from the original equipment manufacturer (OEM) except that it preferably does not include the rotational force transmitting assembly. The replacement photoconductive drum or OPC drum may have a drum flange 34 that defines an opening 36 (see FIG. 4) for receiving the ball 30 of the drum gear coupling member 28.

It can be appreciated that new methods of remanufacturing printer cartridges are also introduced by the invention. The new methods of remanufacturing printer cartridges include the various methods of replacing a photoconductive drum or OPC drum of the invention and the conventional remanufacturing steps, including cleaning the used printer cartridge, refilling the toner supply, and sealing the toner hopper.

Before discussing the specific steps involved in the methods for replacing photoconductive drums or OPC drums, it is noted that the order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Figure 3:
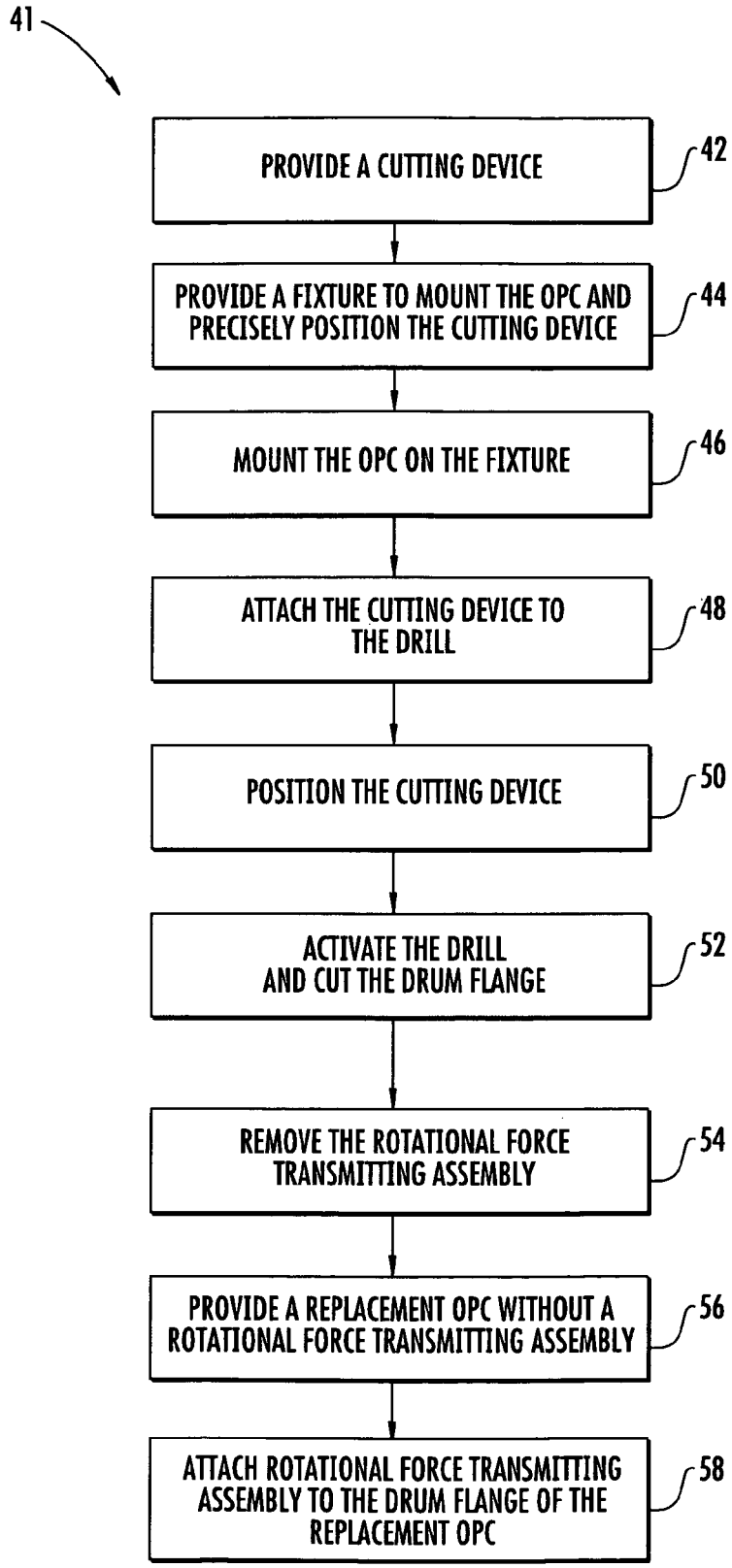
FIG. 3 is a flow diagram showing an embodiment of a method of the invention for replacing a photoconductive drum or OPC drum.

Cutting Method for Removing the Rotational Force Transmitting Assembly—FIG. 3 is a flow diagram showing one of the embodiments of a method 41 of replacing a photoconductive drum or OPC drum of the invention. Referring now to FIG. 3, an embodiment of a method 41 of replacing a photoconductive drum or OPC drum preferably includes the following described steps. The method 41 comprises step 42 of providing a cutting device 60 (see FIG. 4), such as the cutting device 60 described below as preferably provided. The cutting device 60 is preferably designed to cut around the drum flange 34 and allow the removal of the rotational force transmitting assembly 22 without substantial damage to the photoconductive drum or OPC drum 20. The method 41 may further comprise step 44 of providing a fixture 69 (see FIG. 5), such as the fixture 69 described below as preferably provided, to mount the photoconductive drum or OPC drum 20 and precisely position the cutting device 60 so that it can cut the drum flange 34 without substantially damaging the rotational force transmitting assembly 22. The method 41 may further comprise step 46 of mounting the photoconductive drum or OPC drum 20 onto the fixture 69. The method 41 may further comprise step 48 of attaching the cutting device 60 to a drill 78 (see FIG. 5). The method 41 may further comprise step 50 of positioning the cutting device 60 onto the fixture 69 so that the cutting device 60 can cut around the drum flange 34 and allow the removal of the rotational force transmitting assembly 22 without substantial damage to the photoconductive drum or OPC drum 20. The method may further comprise step 52 of activating the drill 78 while driving the cutting device 60 through the drum flange 34 and cutting the drum flange 34 with the cutting device 60. The cutting device 60 preferably cuts through the drum flange 34, which consequently detaches the drum flange 34 and the rotational force transmitting assembly 22 from the drum gear end 24. The method 41 further comprises step 54 of removing the rotational force transmitting assembly 22 from the drum gear end 24. The method 41 may further comprise step 56 of providing a replacement photoconductive drum or OPC drum similar to the photoconductive drum or OPC drum 20 but that does not have a rotational force transmitting assembly 22. A replacement photoconductive drum or OPC drum, such as the replacement photoconductive drum or OPC drum described below, may be provided so that the rotational force transmitting assembly 22 may be attached to the replacement photoconductive drum or OPC drum. The method 41 may further comprise step 58 of attaching the rotational force transmitting assembly 22 to the drum flange 34 of the replacement photoconductive drum or OPC drum. The rotational force transmitting assembly 22 may be attached to the replacement photoconductive drum or OPC drum by pushing the rotational force transmitting assembly 22 into an opening 36 (see FIG. 4) of the drum flange 34. Various embodiments of devices for attaching the rotational force transmitting assembly 22 to the replacement photoconductive drum or OPC drum, such as those described below, may be used.

Figure 4:
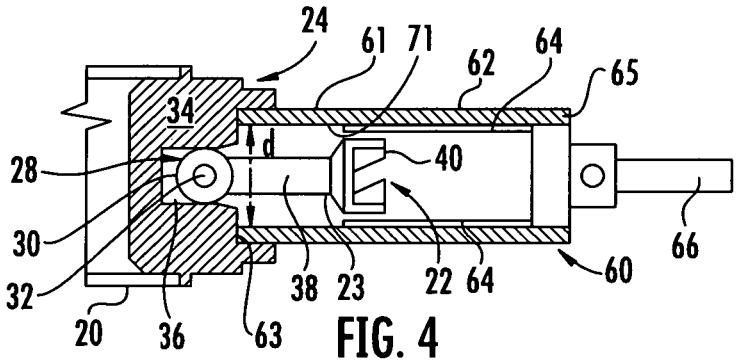
FIG. 4 is a side view in partial cross-section of an embodiment of a remanufacturing device of the invention used to remove a rotational force transmitting assembly from a photoconductive drum or OPC drum.

Cutting Device—FIG. 4 is a side view in partial cross-section of an embodiment of a remanufacturing device of the invention used to remove a rotational force transmitting assembly from a photoconductive drum or OPC drum. With reference now to FIG. 4, an embodiment of a cutting device 60 is shown. The cutting device 60 is preferably in the form of a hole saw 61 having a recessed cylindrical body 62 with a serrated end 63 and a non-serrated end 65. The hole saw 61 preferably includes an internal diameter (d) that is sized to accommodate the printer coupling member 40 within its recessed cylindrical body 62. The internal diameter (d) is preferably sized also to ensure that the serrated end 63 of the hole saw 61 will not contact any portion of the drum gear coupling member 28, including the ball 30 and the pin 32. A protective sheet of material 64, such as plastic, rubber, and the like, preferably surrounds the internal walls of the cylindrical body 62 of the hole saw 61 to minimize damage to the rotational force transmitting assembly 22. The height of the hole saw 61 is preferably sized such that the hole saw 61 can penetrate through the drum flange 34.

Figure 5:
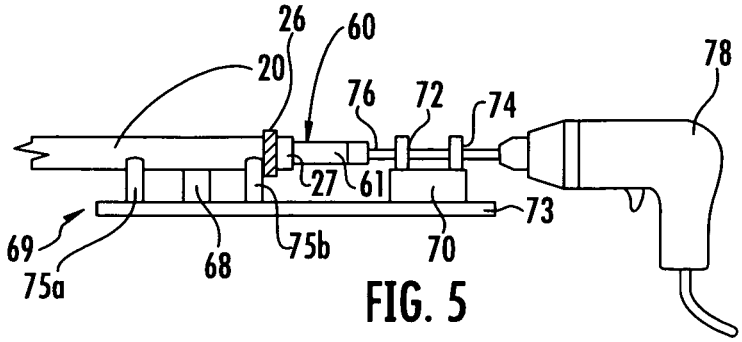
FIG. 5 is a side view of a fixture used with another embodiment of a remanufacturing device of the invention used to remove a rotational force transmitting assembly from a photoconductive drum or OPC drum.

To use the hole saw 61, the non-serrated end 65 of the hole saw 61 is preferably attached to an arbor 66 and to a drill 78 (see FIG. 5). The recessed cylindrical body 62 preferably encloses the printer coupling member 40 and the drive shaft 38, and the protective sheet of material 64 preferably surrounds an interior wall portion 71 of the cylindrical body 62 of the hole saw 61. The serrated end 63 of the hole saw 61 may be positioned to contact the drum flange 34. The drill 78 may be activated to rotate the hole saw 61 and allow the hole saw 61 to cut through the drum flange 34.

The hole saw 61 preferably cuts out a cylindrically shaped portion (not shown) of the drum flange 34. The drive shaft 38 or the printer coupling member 40 may be handled and pulled to remove the cylindrically shaped cut portion of the drum flange 34 from the photoconductive drum or OPC drum 20. The rotational force transmitting assembly 22 may be preserved for use with the replacement photoconductive drum or OPC drum. Various cutting devices other than a hole saw may also be used, for example, rotary tools.

Fixture—FIG. 5 is a side view of a fixture 69 used to support the device 60, in the form of the hole saw 61, used to remove the rotational force transmitting assembly 22 from the photoconductive drum or OPC drum 20. With reference now to FIG. 5, an embodiment of the fixture 69, which may be used to support the photoconductive drum or OPC drum 20 and the cutting device 60 when removing the rotational force transmitting assembly 22 from the OPC drum, is shown. The fixture 69 preferably includes a base 73 that may be mounted on any flat surface. One or more drum mounting blocks 75*a*, 75*b* are preferably attached to the base 73. Drum mounting blocks 75*a*, 75*b* are preferably positioned adjacent to each other on the base 73 to support the photoconductive drum or OPC drum 20. It is noted that drum mounting block 75*b* preferably also serves as a drum stop configured to abut to the drum gear 26 to prevent horizontal forward movement of the photoconductive drum or OPC drum 20 when the rotational force transmitting assembly 22 is being removed from the photoconductive drum or OPC drum 20. A clamp 68 is preferably positioned in between the drum mounting blocks 75*a*, 75*b* on the base 73. The clamp 68 is preferably designed to secure the photoconductive drum or OPC drum 20 to the base 73. A guide mounting block 70 is preferably also attached to the base 73. The guide mounting block 70 preferably holds two drill shaft guides 72 and 74 configured to support a drill shaft 76.

To use the fixture 69, a photoconductive drum or OPC drum 20 is preferably positioned on top of the drum mounting blocks 75*a*, 75*b*. The clamp 68 is preferably used to hold down the photoconductive drum or OPC drum 20 to the base 73. The hole saw 61 is preferably positioned over the printer coupling member 40 and the drive shaft 38. The serrated end 63 of the hole saw 61 is preferably positioned to contact the drum flange 34 (see FIG. 4). The drill shaft 76 is preferably inserted through the first drill shaft guide 72 and the second drill shaft guide 74 and attached to the hole saw 61. At the end opposite the hole saw 61, the drill shaft 76 is preferably attached to the drill 78. The drill 78 may be activated, which causes the hole saw 61 to cut through the drum flange 34. The cut drum flange 34 may be removed from the photoconductive drum or OPC drum 20, and the rotational force transmitting assembly 22 may subsequently be removed from the photoconductive drum or OPC drum 20.

Figure 6A:
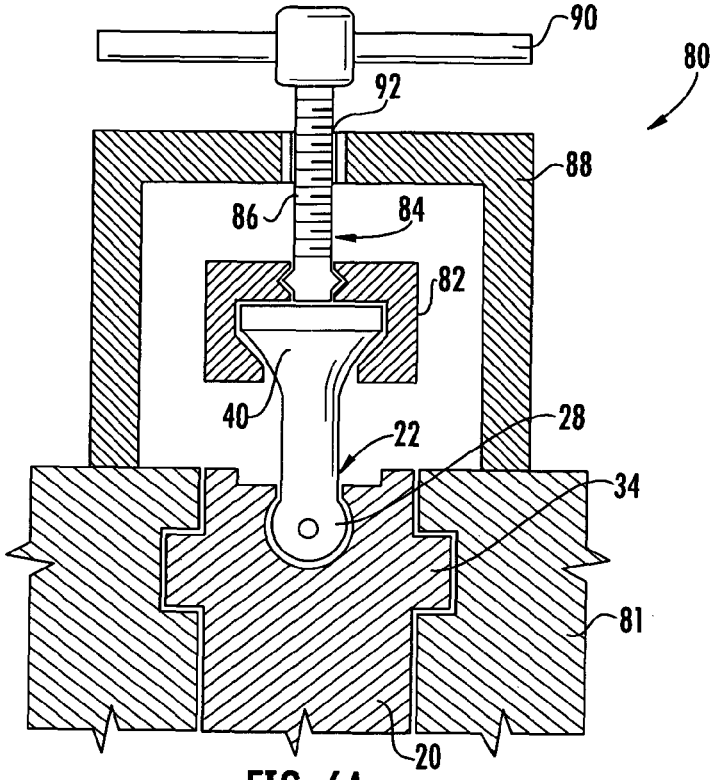
FIG. 6A is a front view in partial cross-section of an embodiment of a device for pulling and reinstalling a rotational force transmitting assembly from a photoconductive drum or OPC drum.

Other Methods and Devices for Removing and/or Installing the Rotational Force Transmitting Assembly—With reference now to FIGS. 6A-6D, the invention includes a device 80 for removing and installing the rotational force transmitting assembly 22 from the photoconductive drum or OPC drum 20 in a printer cartridge 81. FIG. 6A is a front view in partial cross-section of an embodiment of the device 80 for pulling and reinstalling the rotational force transmitting assembly 22 from the photoconductive drum or OPC drum 20. As shown in FIG. 6A, the device 80 preferably includes a printer coupling member clamp 82 attached to a driving assembly 84. The driving assembly 84 preferably resembles a jackscrew and comprises a drive member 86 attached to a handle 90. The driving assembly 84 is preferably supported by a frame 88, which preferably defines a drive member receiver 92. The drive member receiver 92 and the drive member 86 preferably have mating threads to controllably move the drive member 86. It can be appreciated that the movement of the drive member 86 in one direction causes the removal of the rotational force transmitting assembly 22 from the drive flange 34. The movement of the drive member 86 in the opposite direction allows for the attachment of the rotational force transmitting assembly 22 to the drive flange 34.

Figure 6B:
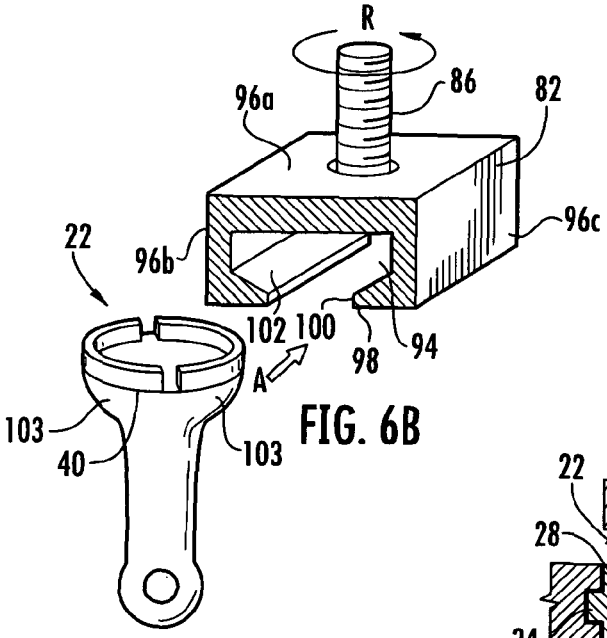
FIG. 6B is a perspective view of a clamp and a rotational force transmitting assembly of the device of FIG. 6A.
Figure 6C:
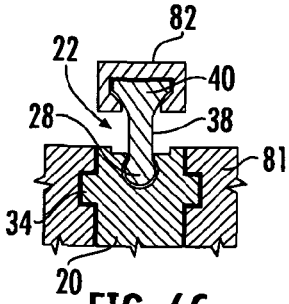
FIG. 6C is a close-up cross-sectional front view of the clamp of FIG. 6B engaged with a rotational force transmitting assembly attached to a photoconductive drum or OPC drum.
Figure 6D:
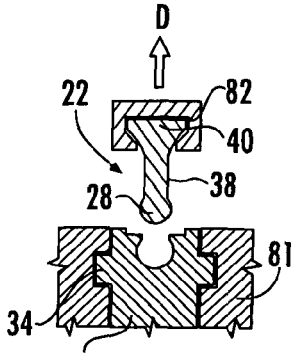
FIG. 6D a close-up cross-sectional front view of the clamp of FIG. 6B engaged with a rotational force transmitting assembly detached from a photoconductive drum or OPC drum.

FIG. 6B is a perspective view of the printer coupling member clamp 82 of the device 80 of FIG. 6A. With reference now to FIG. 6B, the printer coupling member clamp 82 preferably includes three walls 96*a*, 96*b* and 96*c*, and a partial wall 98, which defines a recess 94 shaped to accommodate the printer coupling member 40. Partial wall 98 preferably includes two opposing lips 100, 102 configured to abut to side surfaces 103 of the printer coupling member 40 when removing the rotational force transmitting assembly 22 from the drum flange 34. The drive member 86 may be rotated in rotational direction "R" to disengage from the rotational force transmitting assembly 22. FIG. 6C is a close-up cross-sectional front view of the clamp 82 of FIG. 6B engaged with the rotational force transmitting assembly 22 attached to the photoconductive drum or OPC drum 20. FIG. 6D a close-up cross-sectional front view of the clamp 82 of FIG. 6B engaged with the rotational force transmitting assembly 22 detached from the photoconductive drum or OPC drum 20. Referring to FIG. 6D, it can be appreciated that with the device 80, the rotational force transmitting assembly 22 can cleanly be removed from the photoconductive drum or OPC drum 20 in direction "D", as the drum gear coupling member 28 simply slips out of the drum flange 34.

Figure 7:
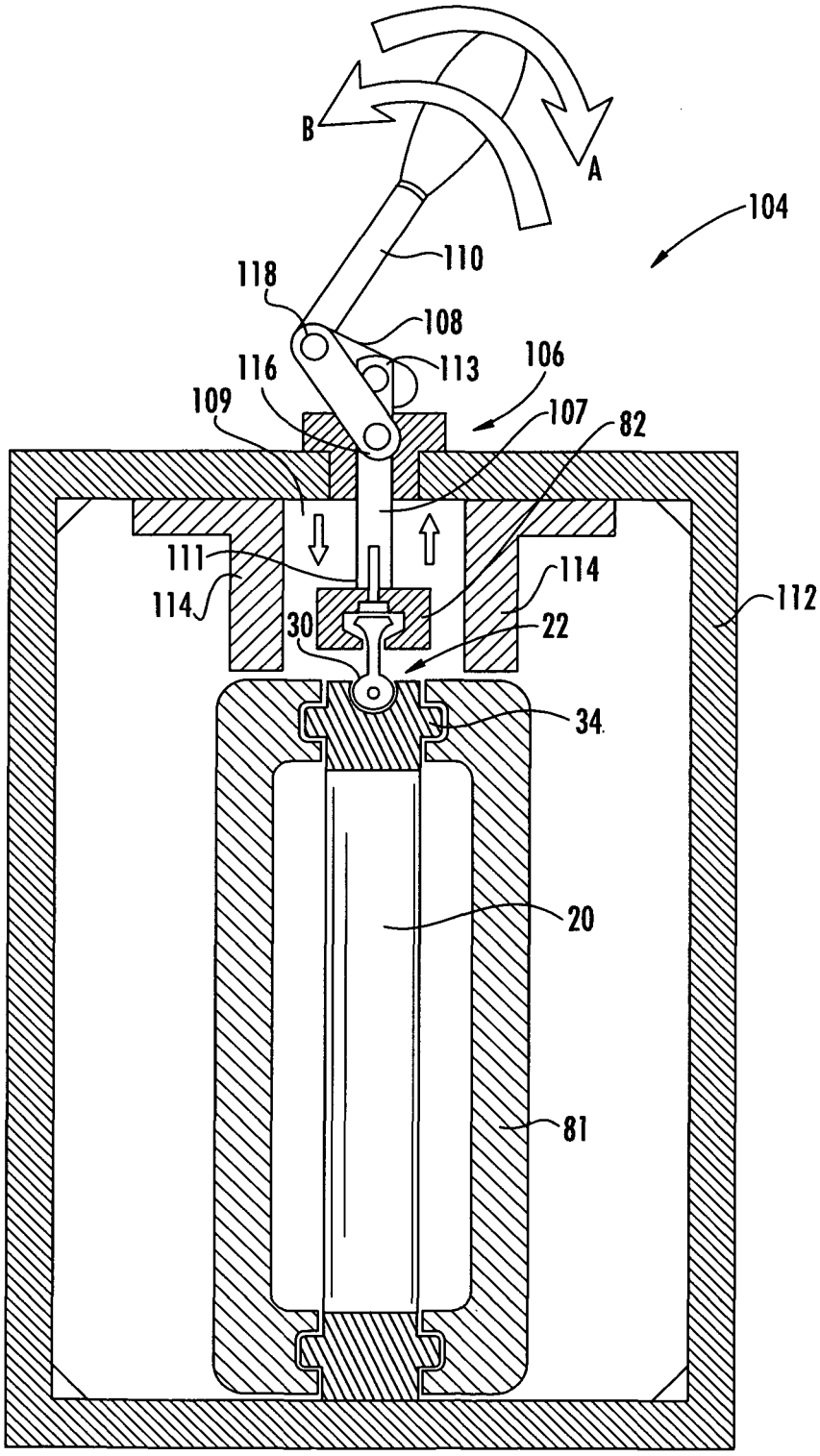
FIG. 7 is a front view in partial cross-section of another embodiment of a device for pulling and reinstalling a rotational force transmitting assembly from a photoconductive drum or OPC drum.

Additional Embodiments—Referring now to FIG. 7, another embodiment of a device 104 for removing and installing the rotational force transmitting assembly 22 to the photoconductive drum or OPC drum 20 is shown. FIG. 7 is a front view in partial cross-section of the device 104 for pulling or removing and reinstalling the rotational force transmitting assembly 22 from the photoconductive drum or OPC drum 20. Device 104 preferably includes a frame 112 configured to support a driving assembly 106. The frame 112 is preferably also configured to provide a snug fit to the printer cartridge 81 and hold the printer cartridge 81 while the rotation force transmitting assembly 22 is being removed from or installed into the photoconductive drum or OPC drum 20. To provide a snug fit to the printer cartridge 81, the frame 112 preferably includes a plurality of spacers 114 attached thereto to minimize the movement of the printer cartridge 81.

Device 104 preferably has a different driving assembly 106 compared to the driving assembly 84 of device 80. Driving assembly 106 preferably includes a drive shaft 107, which traverses a wall 109 of the frame 112. The drive shaft 107 is preferably connected to the clamp 82 on one end 111 and is connected to a pivot arm 108 at another end 113. One end 116 of the pivot arm 108 is preferably attached at an angle to the drive shaft 107 outside the periphery of the frame 112. Another end 118 of the pivot arm 108 is preferably connected to a handle 110. The handle 110 and the pivot arm 108 operate in a manner wherein the movement of the handle 110 in a first direction "A" causes: (1) the pivot arm 108 to pivot toward the handle 110, and (2) the drive shaft 107 to move toward the handle 110. The movement of the drive shaft 107 toward the handle 110 creates sufficient force to detach the ball 30 of the rotational force transmitting assembly 22 from the drum flange 34 from the photoconductive drum or OPC drum 20.

The movement of the handle 110 in a second direction "B" causes: (1) the pivot arm 108 to pivot away from the handle 110, and (2) the drive shaft 107 to move away from the handle 110. The movement of the drive shaft 107 away from the handle 110 creates sufficient force to push the ball 30 of the rotational force transmitting assembly 22 through the drum flange 34 thereby attaching the rotational force transmitting assembly 22 to the photoconductive drum or OPC drum 20.

Figure 8:
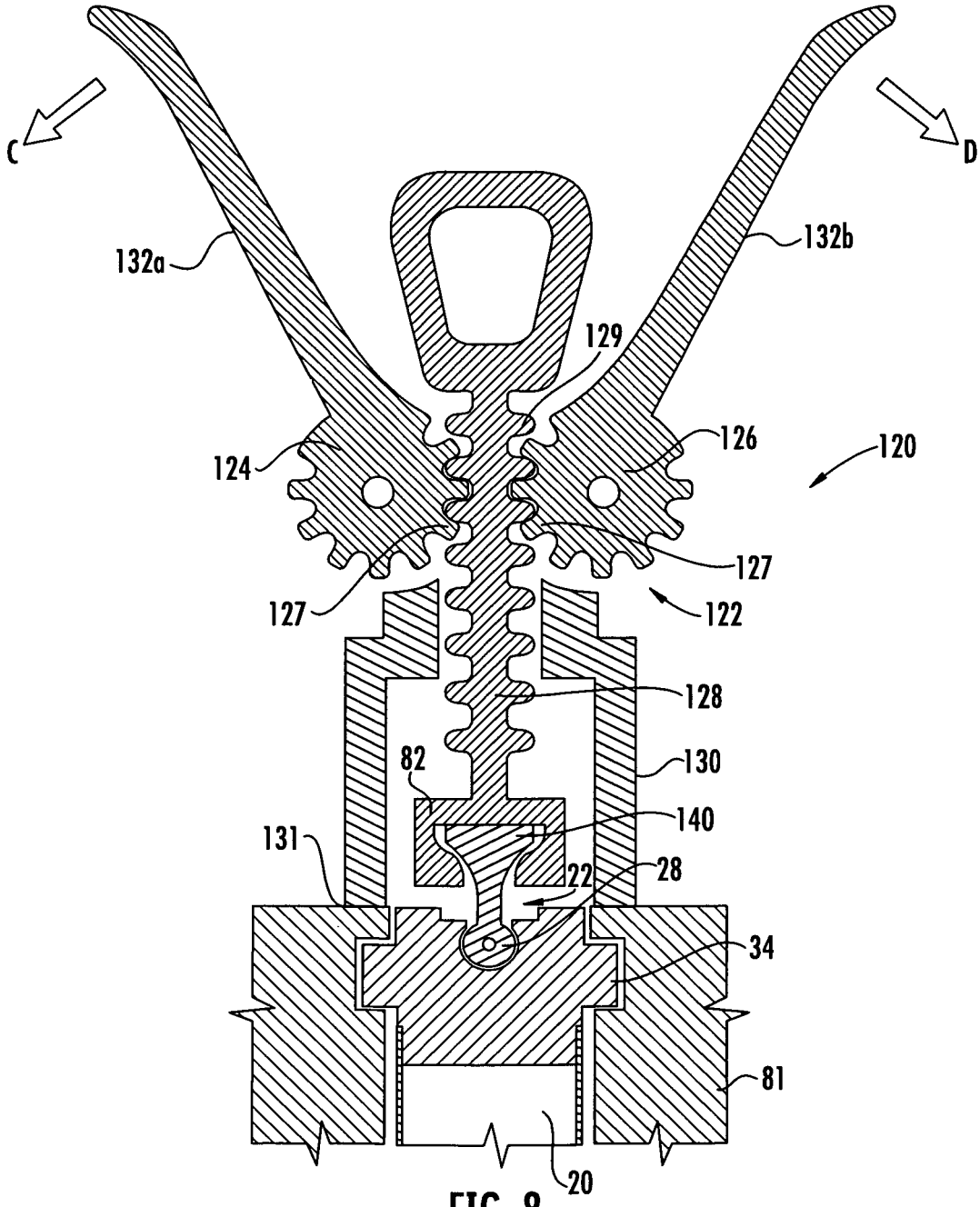
FIG. 8 is a front view in partial cross-section of another embodiment of a device for pulling a rotational force transmitting assembly off a photoconductive drum or OPC drum.

Referring now to FIG. 8, another embodiment of a device 120 for removing the rotational force transmitting assembly 22 from the photoconductive drum or OPC drum 20 is shown. FIG. 8 is a front view in partial cross-section of the device 120 for pulling or removing the rotational force transmitting assembly 22 from the photoconductive drum or OPC drum 20. Device 120 preferably includes a driving assembly 122 that resembles a rack and pinion gear. Driving assembly 122 preferably includes multiple wheels 124, 126 each having gear teeth 127 that are coupled to or adjacent to a frame 130. The multiple wheels 124, 126 with gear teeth 127 preferably extend to their respective wings 132*a*, 132*b*, which may serve as handles in operating the driving assembly 122. The gear teeth 127 of the multiple wheels 124, 126 are preferably connected to gears 129 of a drive shaft 128. The drive shaft 128 is preferably connected to a clamp 82.

The frame 130 can be positioned on top of a drum gear side 131 of a printer cartridge 81. The printer coupling member 40 can be inserted into the clamp 82 that is attached to the drive shaft 128. The wings 132*a* and 132*b* that are connected to the multiple wheels 124, 126 can be moved in respective directions "C" and "D" to rotate the multiple wheels 124, 126. The rotation of the multiple wheels 124, 126 with gear teeth 127 causes the drive shaft 128 to move linearly. The linear movement of the drive shaft 128 is sufficient to detach the drum gear coupling member 28 from the drum flange 34. It is noted that as the drum gear coupling member 28 is removed from the drum flange 34, the printer cartridge 81 may have a tendency to move with the drum gear coupling member 28. The frame 130 provides leverage by providing an opposing force to the printer cartridge 81 movement.

Figure 9B:
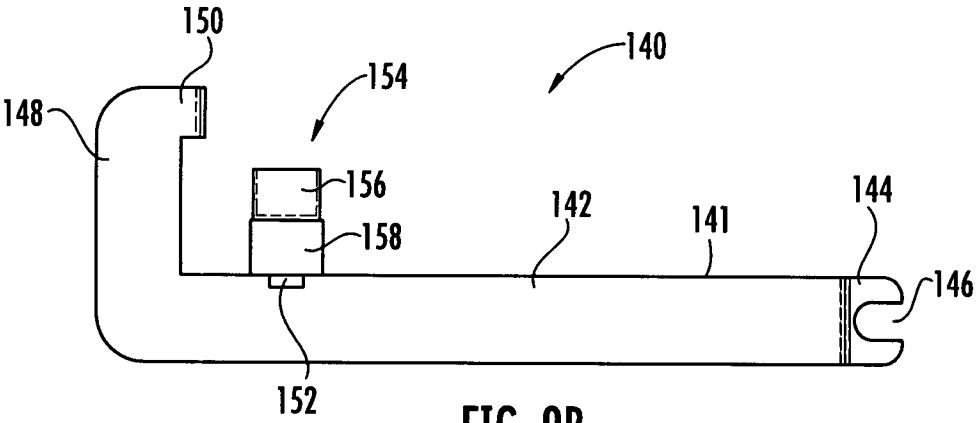
FIG. 9B is a back view of the device of FIG. 9A.
Figure 9C:
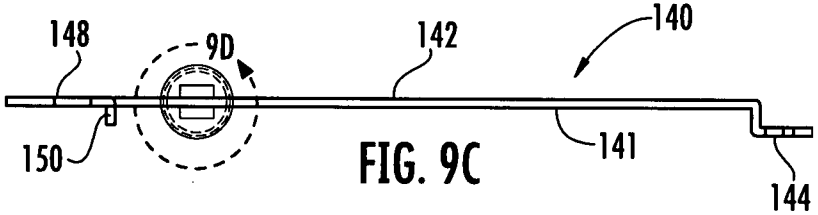
FIG. 9C is a right side view of the device of FIG. 9A.
Figure 9D:
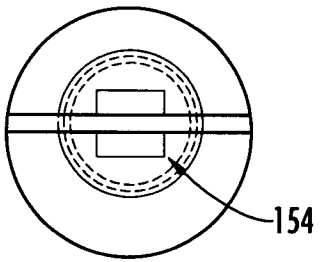
FIG. 9D is a close-up view of circle 9D of FIG. 9C.
Figure 9A:
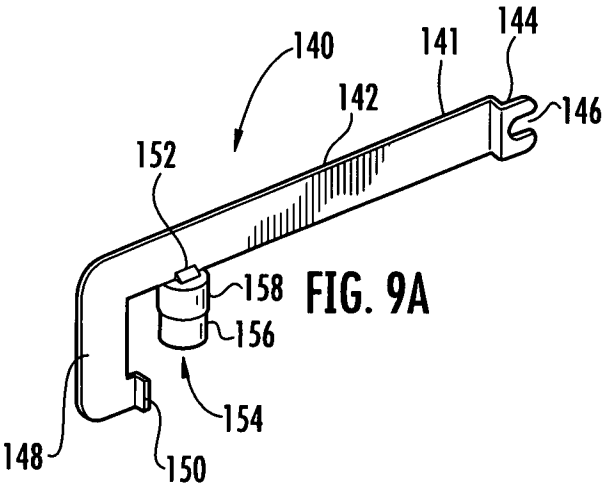
FIG. 9A is a front perspective view of another embodiment of a device for removing and reinstalling a rotational force transmitting assembly from a photoconductive drum or OPC drum.
Figure 13:
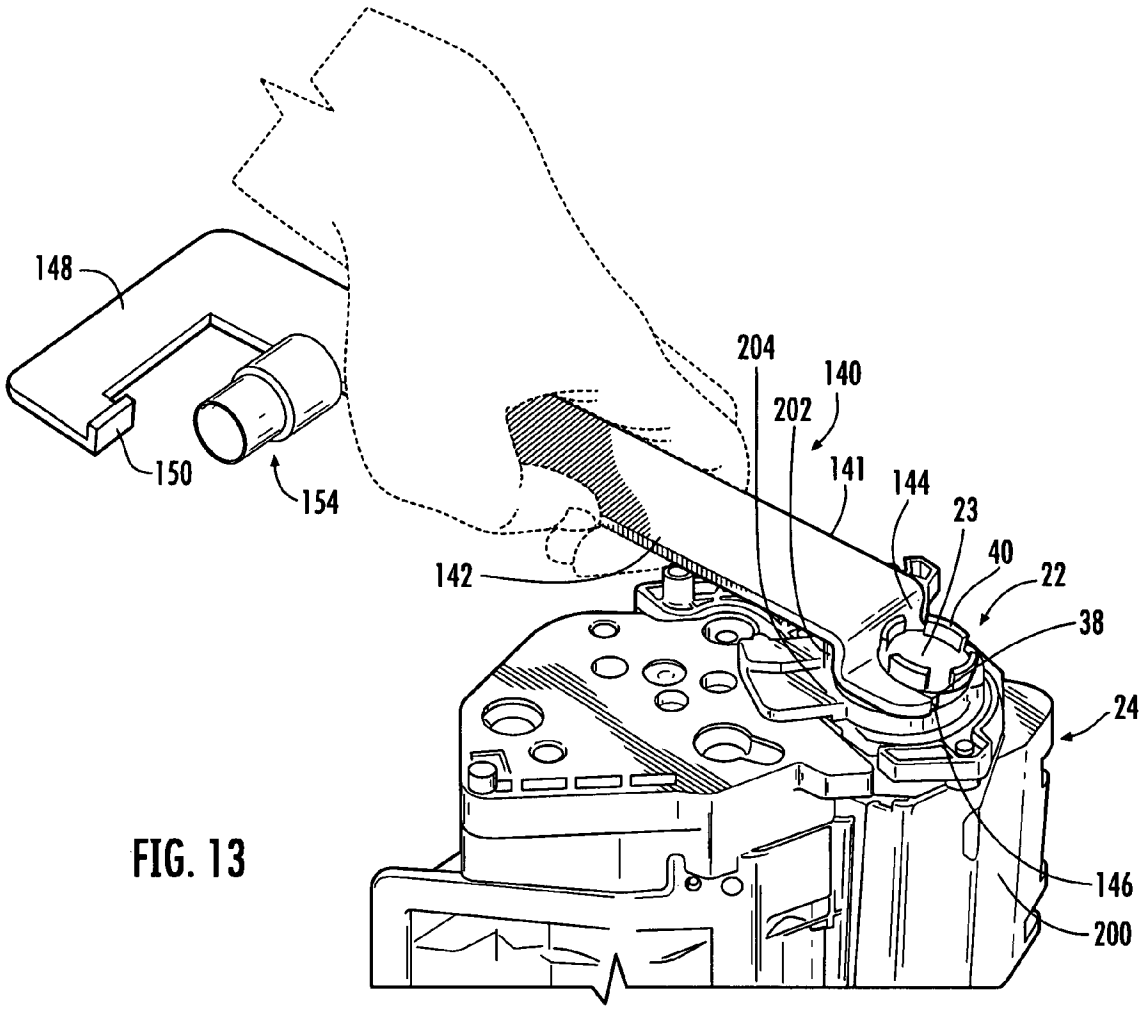
FIG. 13 is a perspective view of an embodiment of a drum gear end of a printer cartridge showing the device of FIG. 9A in use to remove a rotational force transmitting assembly in the form of a drum drive axle.
Figure 14:
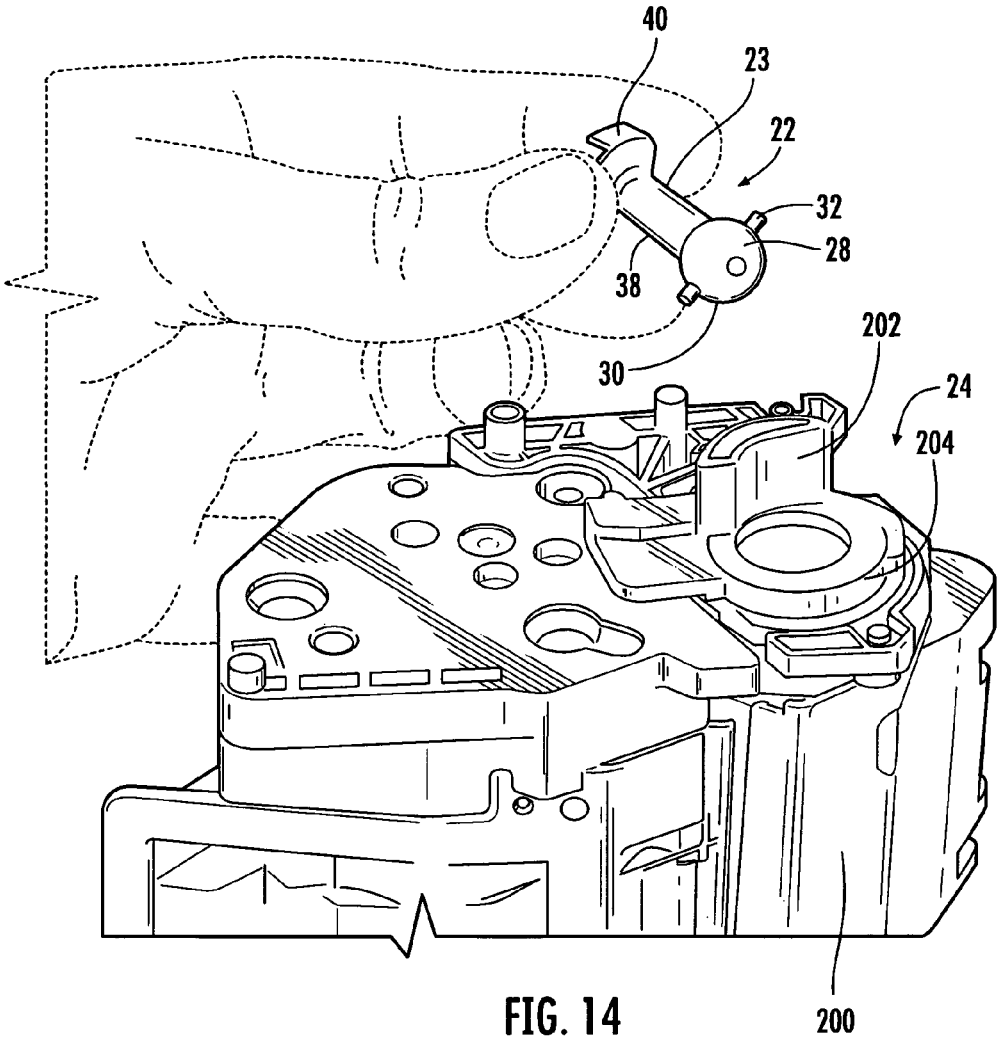
FIG. 14 is a perspective view of the drum gear end of the printer cartridge of FIG. 13 showing a rotational force transmitting assembly in the form of a drum drive axle removed.

FIGS. 9A-9D show another embodiment of a device 140 for removing and installing a rotational force transmitting assembly from a photoconductive drum or OPC drum. FIG. 9A is a front perspective view of the device 140 in the form of a drum drive axle tool 141 for removing and installing the rotational force transmitting assembly 22, in the form of a drum drive axle 23, from the photoconductive drum or OPC drum (see FIGS. 13-17). The drum drive axle tool 141 may be substantially L-shaped in configuration and comprises an elongated body 142 with a first bent end 144 having a C-shaped claw portion 146. The drum drive axle tool 141 further comprises a second elongated end 148 having a bent end piece 150. The first bent end 144 may form a substantially 90 degree angle with the C-shaped claw portion 146. The second elongated end 148 may at one end form a substantially 90 degree angle with the elongated body 142 and may at the opposite end form a substantially 90 degree angle with the bent end piece 150. Although the drum drive axle tool 141 is shown in a substantially L-shaped configuration, the drum drive axle tool 141 may also comprise other suitable configurations. The C-shaped claw portion 146 is designed to grip the drive shaft 38 of the rotational force transmitting assembly 22, in the form of the drum drive axle 23, when removing the drum drive axle 23 from the photoconductive drum or OPC drum 20 of a printer cartridge 200 (see FIG. 13). FIG. 13 is a perspective view of a drum gear end 24 of the printer cartridge 200 showing the device 140 of FIG. 9A in use to remove the rotational force transmitting assembly 22 in the form of the drum drive axle 23. As shown in FIG. 13, to remove the drum drive axle 23, the C-shaped claw portion 146 mat be inserted under the printer coupling member 40 of the drum drive axle 23. The C-shaped claw portion 146 may be positioned against a lip 202 (see FIG. 14) formed on a drum end plate 204 in order to support and leverage the drum drive axle tool 141 to pry the drum drive axle 23 out of and away from the photoconductive drum or OPC drum. FIG. 14 is a perspective view of the drum gear end 24 of the printer cartridge 200 of FIG. 13 showing the rotational force transmitting assembly 22 in the form of the drum drive axle 23 removed. As shown in FIG. 14, the rotational force transmitting assembly 22 in the form of the drum drive axle 23 has been removed from the photoconductive drum or OPC drum (not shown) of the printer cartridge 200 by the device 140 in the form of the drum drive axle tool 141.

Figure 10C:
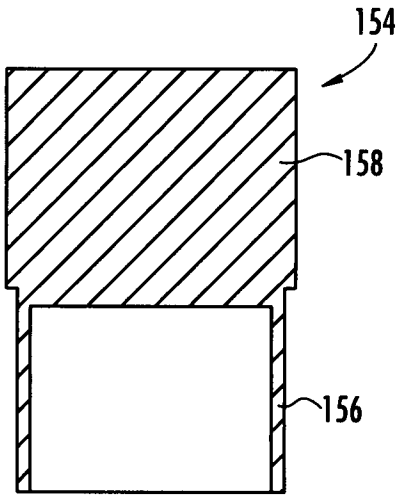
FIG. 10C is a cross-sectional view taken along lines 10C-10C of FIG. 10B.
Figure 10B:
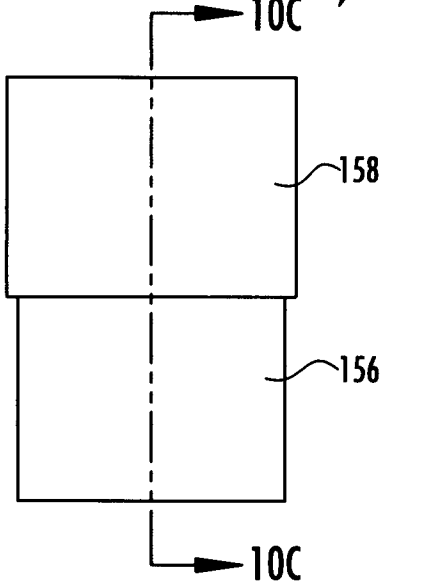
FIG. 10B is a front view of the press part of FIG. 10A.
Figure 10A:
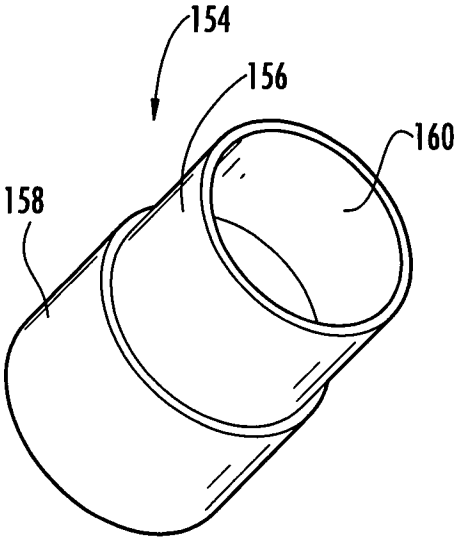
FIG. 10A is a perspective close-up view of a press part shown in FIG. 9A.
Figure 15:
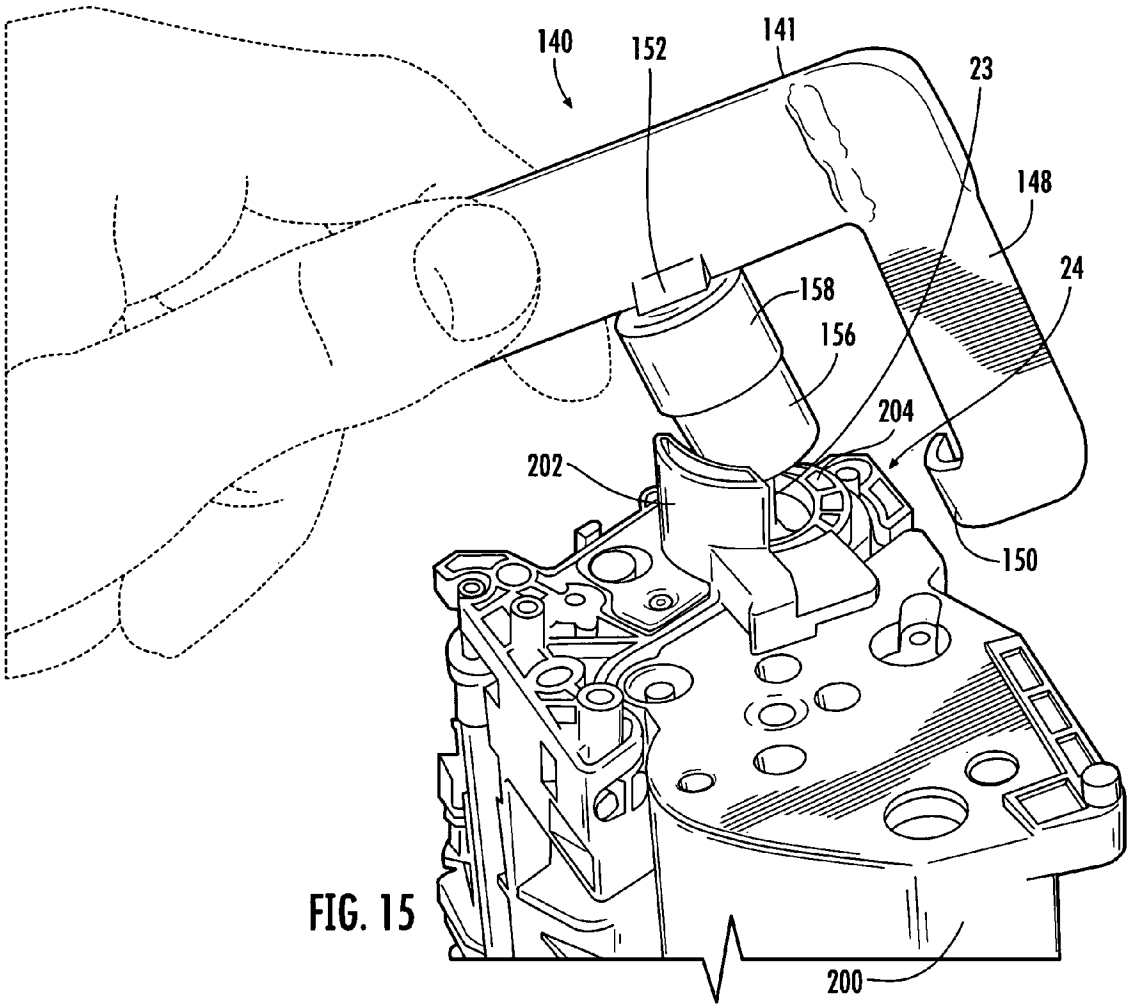
FIG. 15 is a perspective view of the drum gear end of the printer cartridge of FIG. 13 showing the device of FIG. 9A in use to install a rotational force transmitting assembly in the form of a drum drive axle.
Figure 16:
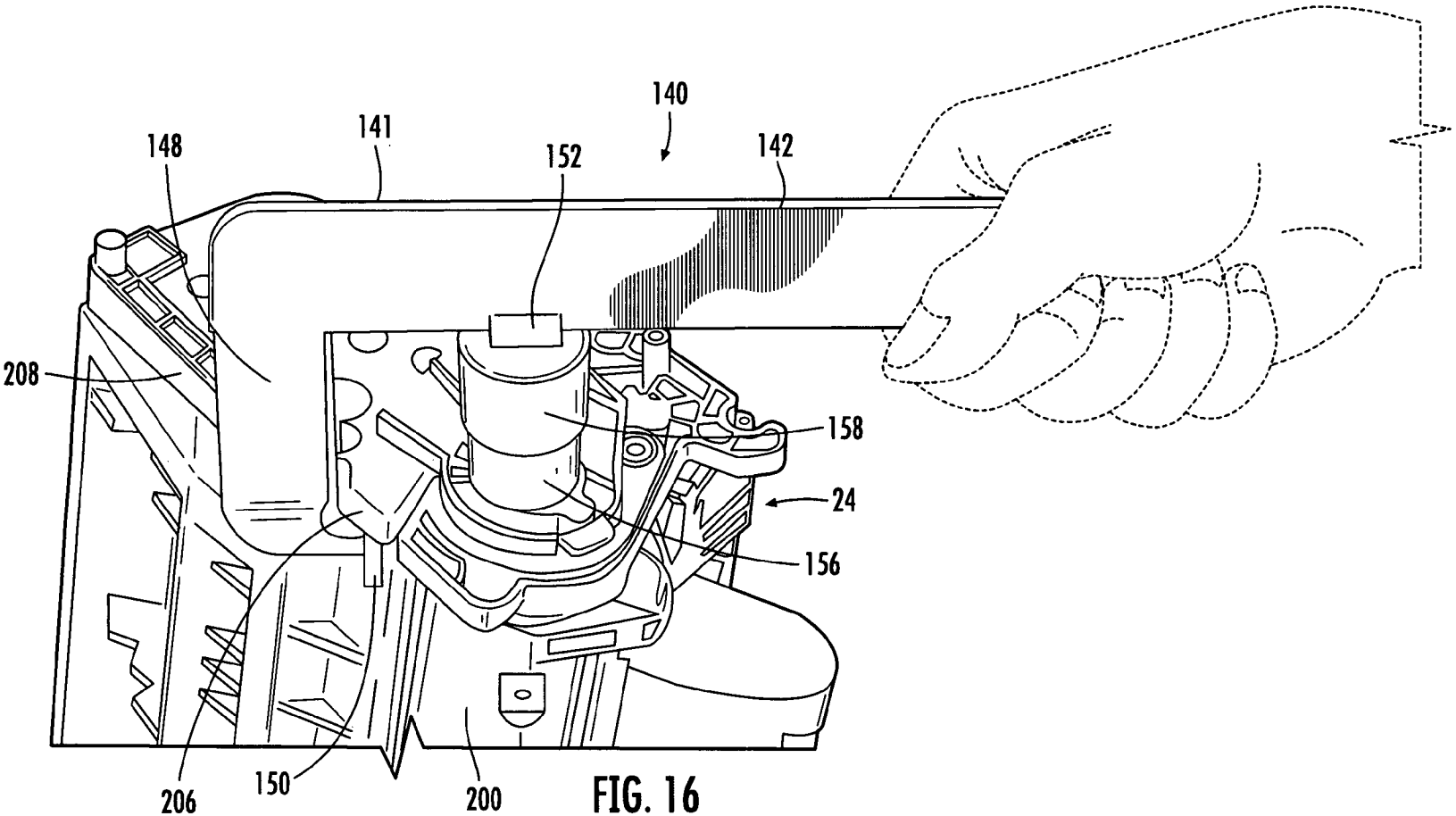
FIG. 16 is a perspective view of the drum gear end of the printer cartridge of FIG. 13 showing the device of FIG. 9A in use to further install the rotational force transmitting assembly in the form of a drum drive axle; and, FIG. 17 is a perspective view of the drum gear end of the printer cartridge of FIG. 13 showing the rotational force transmitting assembly in the form of a drum drive axle installed.
Figure 17:
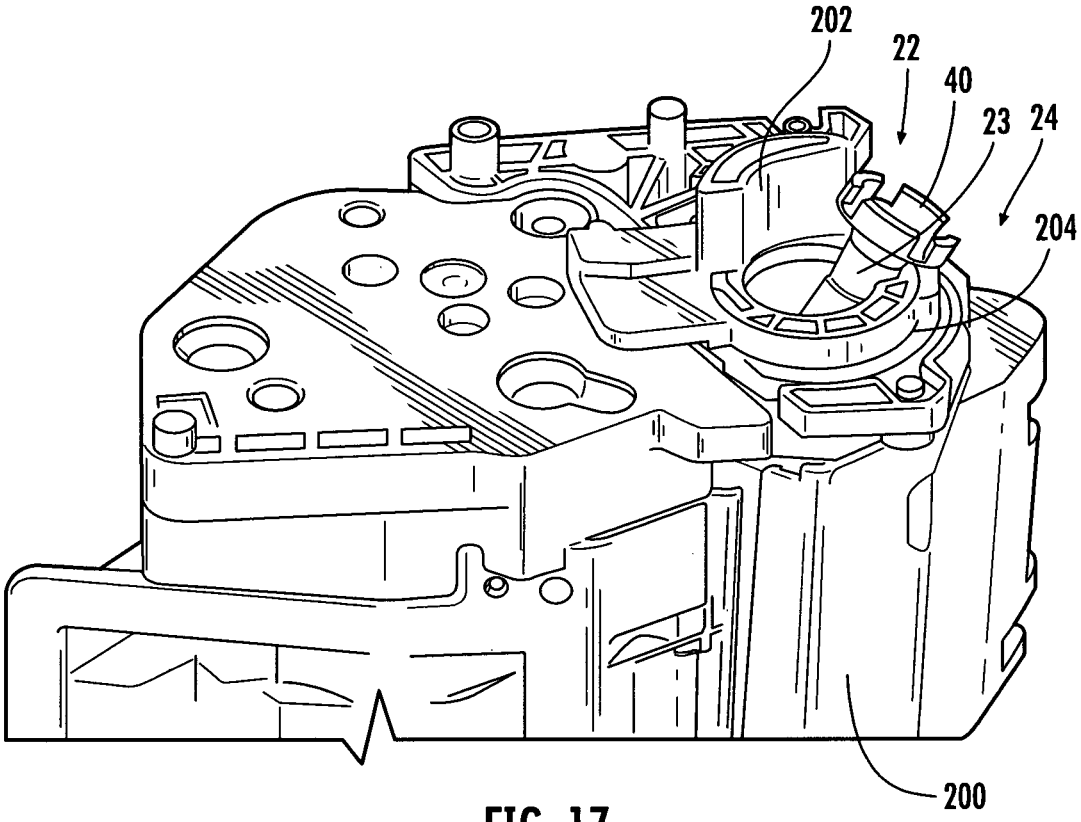

The device 140 in the form of the drum drive axle tool 141 further comprises a press part 154 attached to the body 142 of the drum drive axle tool 141 at attachment portion 152. In this embodiment, the press part 154 may be in a cylindrical telescoped configuration and may comprise a first portion 156 and a second portion 158. The press part 154 may be permanently attached to the elongated body 142 of the drum drive axle tool 141 via welding or another suitable attachment process. In another embodiment, the press part 154 may be removable or detachable from the elongated body 142 of the drum drive axle tool 141, and the attachment portion 152 may comprise a screw fit design, a snap fit design, or another suitable removable attachment mechanism for attaching and detaching the press part 154 to and from the elongated body 142. FIG. 9B is a back view of the device 140 of FIG. 9A. FIG. 9C is a right side view of the device 140 of FIG. 9A. FIG. 9D is a close-up view of circle 9D of FIG. 9C with a close-up of the press part 154. FIGS. 10A-10C show the press part 154 used with the device 140. FIG. 10A is a perspective view of the press part 154 shown in FIG. 9A. The press part 154 further comprises an opening 160 at the end of first portion 156. FIG. 10B is a front view of the press part 154 of FIG. 10A. FIG. 10C is a cross-sectional view taken along lines 10C-10C of FIG. 10B. As can be seen by FIG. 10C, in this embodiment the portion 156 has a hollow interior with opening 160 opening into the hollow interior, and the portion 158 has a solid interior. Although the press part 154 is shown in a cylindrical telescoped configuration, the press part 154 may have other suitable configurations. The opening 160 of the press part 154 is designed to fit over and grip the printer coupling member 40 of the rotational force transmitting assembly 22, in the form of the drum drive axle 23, when installing the drum drive axle 23 into the photoconductive drum or OPC drum 20 of the printer cartridge 200 (see FIGS. 15-16). FIG. 15 is a perspective view of the drum gear end 24 of the printer cartridge 200 of FIG. 13 showing the device 140 of FIG. 9A in use to install the rotational force transmitting assembly 22 in the form of the drum drive axle 23. As shown in FIG. 15, to install the drum drive axle 23, the printer coupling member 40 of the drum drive axle 23 is preferably inserted into the opening 160 (see FIG. 10A) of the press part 154 and the drum drive axle tool 141 is preferably positioned on top of the drum drive axle 23. FIG. 16 is a perspective view of the drum gear end 24 of the printer cartridge 200 showing the device 140 of FIG. 9A in use to further install the rotational force transmitting assembly 22 in the form of the drum drive axle 23. As shown in FIG. 16, the press part 154 of the drum drive axle tool 141 is preferably positioned over the drum drive axle 23 (not shown), and the bent end portion 150 of the second elongated end 148 is preferably positioned under an extended flange 206 of a waste hopper gear end 208 of the printer cartridge 200 in order to leverage the drum drive axle tool 141 so that the drum drive axle 23 can be pressed down by the drum drive axle tool 141 and snapped into place within the drum flange 34 of the photoconductive drum or OPC 20 drum. FIG. 17 is a perspective view of the drum gear end 24 of the printer cartridge 200 showing the rotational force transmitting assembly 22 in the form of the drum drive axle 23 installed. As shown in FIG. 17, the rotational force transmitting assembly 22 in the form of the drum drive axle 23 has been installed and snapped into place within the drum flange 34 of the photoconductive drum or OPC drum (not shown) of the printer cartridge 200 by the device 140 in the form of the drum drive axle tool 141.

The drum axle removal tool 141 may be made of a metal such as stainless steel, aluminum, titanium, or another suitable metal, may be made of a strong, sturdy, and durable plastic material, or may be made of another suitable strong, sturdy, and durable material. The drum axle removal tool 141 may preferably be used to remove and install the drum drive axle of photoconductive drums or OPC drums used with laser printer cartridges for use in laser printers or electrophotographic image forming devices. The inventive device 140 may be used with laser printer cartridges used in exemplary laser printers or electrophotographic image forming devices, such as original equipment manufacturer (OEM) laser printer models HP LaserJet P2035 from Hewlett-Packard Company, HP LaserJet P2055 from Hewlett-Packard Company, and HP LaserJet P2055dn from Hewlett-Packard Company. However, the device 140 may also be used with laser printer cartridges used in other suitable laser printers or electrophotographic image forming devices.

Figure 11B:
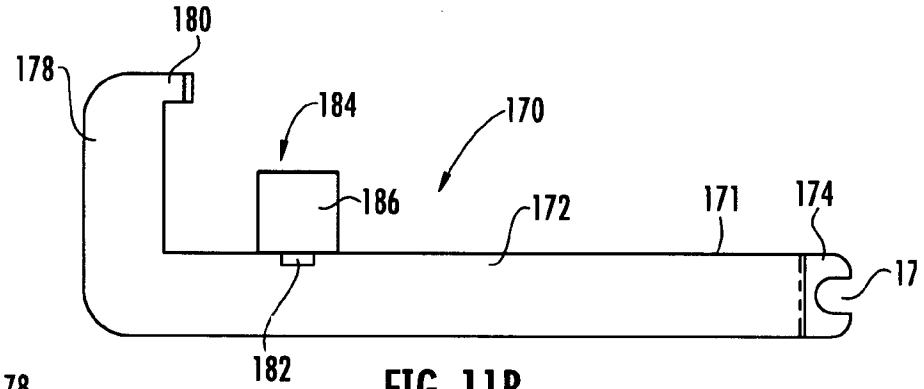
FIG. 11B is a back view of the device of FIG. 11A.
Figure 11C:
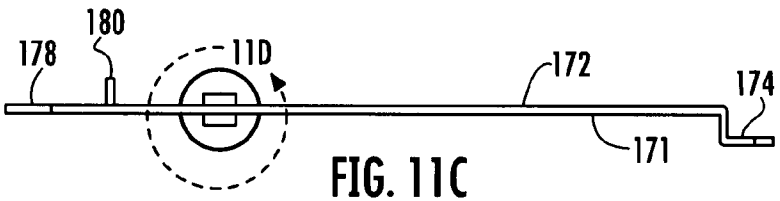
FIG. 11C is a right side view of the device of FIG. 11A.
Figure 11D:
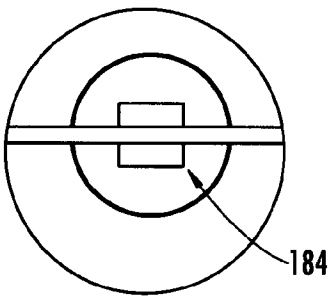
FIG. 11D is a close-up view of circle 11D of FIG. 11C.
Figure 11A:
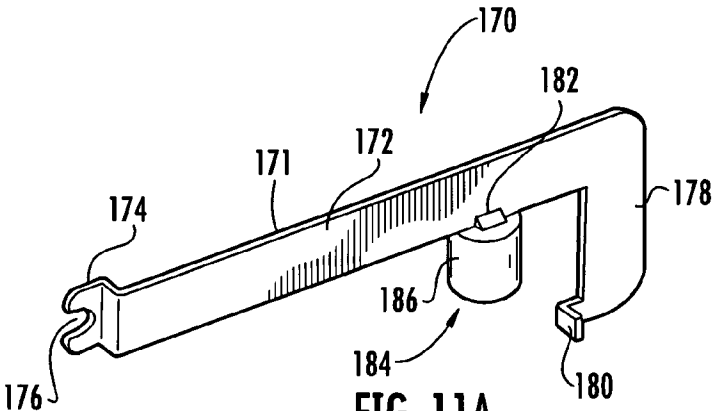
FIG. 11A is a front perspective view of another embodiment of a device for removing and reinstalling a rotational force transmitting assembly from a photoconductive drum or OPC drum.

FIGS. 11A-11D show another embodiment of a device 170 for removing the rotational force transmitting assembly 22 from the photoconductive drum or OPC drum 20. The device 170 is similar to device 140 except that device 170 is larger and has a different press part configuration. FIG. 11A is a front perspective view of the device 170 in the form of a drum drive axle tool 171 for removing the rotational force transmitting assembly 22 off the photoconductive drum or OPC drum 20. The drum drive axle tool 171 may be substantially L-shaped in configuration and comprises an elongated body 172 with a first bent end 174 having a C-shaped claw portion 176. The drum drive axle tool 171 further comprises a second elongated end 178 having a bent end piece 180. The first bent end 174 may form a substantially 90 degree angle with the C-shaped claw portion 176. The second elongated end 178 may at one end form a substantially 90 degree angle with the elongated body 172 and may at the opposite end form a substantially 90 degree angle with the bent end piece 180. Although the drum drive axle tool 171 is shown in a substantially L-shaped configuration, the drum drive axle tool 171 may also comprise other suitable configurations. The C-shaped claw portion 176 is designed to grip the drive shaft 38 of the rotational force transmitting assembly 22, in the form of the drum drive axle 23, when removing the drum drive axle 23 from the photoconductive drum or OPC drum 20 of the printer cartridge 200. Similar to the device 140 used to remove the drum drive axle 23 as shown in FIG. 13, the C-shaped claw portion 176 may be inserted under the printer coupling member 40 of the drum drive axle 23. The C-shaped claw portion 176 may be positioned against a lip formed on a drum end plate in order to support and leverage the drum drive axle tool 171 to pry the drum drive axle 23 out of and away from the photoconductive drum or OPC drum, so that the rotational force transmitting assembly 22 in the form of the drum drive axle 23 can be removed from the photoconductive drum or OPC drum of the printer cartridge 200.

Figure 12C:
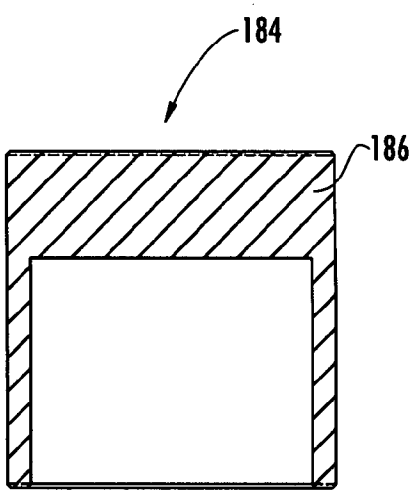
FIG. 12C is a cross-sectional view taken along lines 12C-12C of FIG. 12B.
Figure 12B:
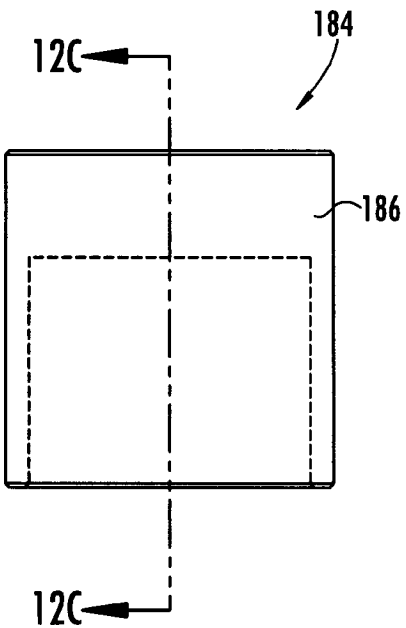
FIG. 12B is a front view of the press part of FIG. 12A.
Figure 12A:
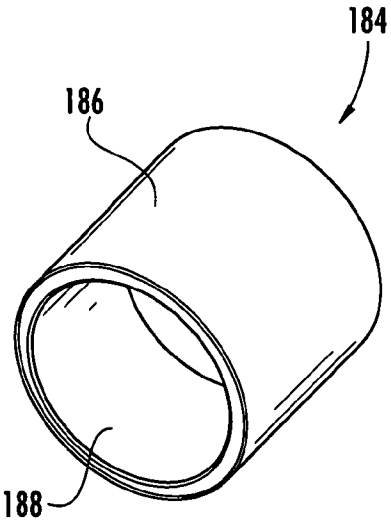
FIG. 12A is a perspective close-up view of a press part shown in FIG. 11A.

The device 170 in the form of a drum drive axle tool 171 further comprises a press part 184 attached to the body 172 of the drum drive axle tool 171 at attachment portion 182. In this embodiment, the press part 184 comprises only a single cylindrical portion 186. The press part 184 may be permanently attached to the elongated body 172 of the drum drive axle tool 171 via welding or another suitable attachment process. In another embodiment, the press part 184 may be removable or detachable from the elongated body 172 of the drum drive axle tool 171, and the attachment portion 182 may comprise a screw fit design, a snap fit design, or another suitable removable attachment mechanism for attaching and detaching the press part 184 to and from the elongated body 172. FIG. 11B is a back view of the device 170 of FIG. 11A. FIG. 11C is a right side view of the device 170 of FIG. 11A. FIG. 11D is a close-up view of circle 11D of FIG. 11D with a close-up of the press part 184. FIGS. 12A-12C show the press part 184 used with the device 170. FIG. 12A is a perspective view of the press part 184 shown in FIG. 11A. The press part 184 further comprises an opening 188 at the end of portion 186. FIG. 12B is a front view of the press part 184 of FIG. 12A. FIG. 12C is a cross-sectional view taken along lines 12C-12C of FIG. 12B. As can be seen by FIG. 12C, in this embodiment the portion 186 has a substantially hollow interior with opening 188 opening into the substantially hollow interior. The opening 188 end can act as a stop to prevent the drum drive axle 23 from being pushed too far into the interior structure of the photoconductive drum or OPC drum to avoid damage to the photoconductive drum or OPC drum. The substantially hollow interior has a suitable depth which may control the penetration of the drum drive axle into the photoconductive drum or OPC drum.

Although the press part 184 is shown in a cylindrical configuration, the press part 184 may have other suitable configurations. The opening 188 of the press part 184 is designed to fit over and grip the printer coupling member 40 of the rotational force transmitting assembly 22, in the form of the drum drive axle 23, when installing the drum drive axle 23 into the photoconductive drum or OPC drum 20 of a printer cartridge having a larger drum drive axle. Similar to the installation of the drum drive axle 23 as shown in FIG. 15, the printer coupling member 40 of the drum drive axle 23 is preferably inserted into the opening 188 of the press part 184 and the drum drive axle tool 171 is preferably positioned on top of the drum drive axle 23. The press part 184 of the drum drive axle tool 171 is preferably positioned over the drum drive axle 23, and the bent end portion 180 of the second elongated end 178 is preferably positioned under an extended flange of a waste hopper gear end of a printer cartridge in order to leverage the drum drive axle tool 171 so that the drum drive axle 23 can be pressed down by the drum drive axle tool 171 and snapped into place within the drum flange 34 of the photoconductive drum or OPC drum 20, so that the rotational force transmitting assembly 22 in the form of the drum drive axle 23 can be installed into the photoconductive drum or OPC drum of the printer cartridge.

The drum axle removal tool 171 may be made of a metal such as stainless steel, aluminum, titanium, or another suitable metal, may be made of a strong, sturdy, and durable plastic material, or may be made of another suitable strong, sturdy, and durable material. The drum axle removal tool 171 may preferably be used to remove and install the drum drive axle of photoconductive drums or OPC drums used with laser printer cartridges for use in laser printers or electrophotographic image forming devices. The inventive device 170 may be used with laser printer cartridges used in exemplary laser printers or electrophotographic image forming devices, such as original equipment manufacturer (OEM) laser printer models HP LaserJet P3015 from Hewlett-Packard Company and HP LaserJet P3011 from Hewlett-Packard Company. However, the device 170 may also be used with laser printer cartridges used in other suitable laser printers or electrophotographic image forming devices.

It can now be realized that with the methods and devices of the invention, printer cartridges with photoconductive drums or OPC drums having rotational force transmitting assemblies can efficiently be remanufactured. The methods and devices of the invention allow for the safe and efficient removal of rotational force transmitting assemblies from used printer cartridges so that they may be reused with replacement photoconductive drums or OPC drums. The devices of the invention include fixtures that simplify the removal of rotational force transmitting assemblies from used printer cartridges. The methods and devices of the invention may be ideal for high volume remanufacturing environments.

Although the description above contains many specifications, these should not be construed as limiting the scope of the invention but as merely providing illustrations of some of the preferred embodiments of this invention. For example, various cutting devices other than a hole saw may be used, including rotary tools. The invention is capable of other embodiments and of being practiced and carried out in various ways. The invention is not limited in its application to the details of the construction and to the arrangement of the components set forth in the above description or as illustrated in the drawings.

What is claimed is:

1. A device for removing a rotational force transmitting assembly of a photoconductive drum of a printer cartridge, the rotational force transmitting assembly comprising a drum gear coupling member configured to attach to a drum flange, the drum gear coupling member having a predetermined diameter, the device comprising:

a hole saw comprising a cylindrical body, the cylindrical body having an internal diameter that is greater than the diameter of the drum gear coupling member, the cylindrical body having a length that allows at least a portion of the cylindrical body to penetrate through the drum flange;

wherein the cylindrical body of the hole saw defines a recess, the device further comprising a protective sheet of material, the protective sheet of material configured to be positioned within the recess to substantially prevent damage to the rotational force transmitting assembly.

2. The device of claim 1, further comprising:

a drill configured to rotate the hole saw;

a fixture comprising:

a base;

at least one mounting block attached to the base, the at least one mounting block being configured to support a photoconductive drum; and, a drill shaft guide connected to the base, the drill shaft guide configured to confine a drill shaft positioned between the hole saw and a drill, wherein the placement of the drill shaft guide relative to the at least one mounting block allows the hole saw to be aligned with the drum flange of the photoconductive drum that is supported by the at least one mounting block.

3. The device of claim 2, wherein the fixture has two mounting blocks positioned adjacent to each other on the base.

4. The device of claim 3, wherein one of the two mounting blocks is a drum stop configured to abut to a drum gear to prevent horizontal forward movement of the photoconductive drum when the rotational force transmitting assembly is removed from the photoconductive drum.

5. The device of claim 1, wherein the hole saw has a recessed cylindrical body with a serrated end and a non-serrated end.

6. The device of claim 5, wherein the internal diameter of the recessed cylindrical body is sized so that the serrated end of the hole saw does not contact the drum gear coupling member.

* * * * *